United States Patent [19]

Atchisson

[11] 4,235,356

[45] Nov. 25, 1980

[54] CONCEALMENT HOLSTER

[76] Inventor: Maxwell G. Atchisson, 6695 Ridgemoor Dr., Doraville, Ga. 30360

[21] Appl. No.: 37,168

[22] Filed: May 8, 1979

[51] Int. Cl.[3] ..... F41C 33/02

[52] U.S. Cl. ..... 224/192; 224/252; 224/911; 2/247; 24/13; 24/155 R

[58] Field of Search ..... 224/903, 911, 914, 182, 224/191, 193, 229, 230, 233, 249, 250, 192, 252; 24/3 R, 13, 48, 49 CP, 59, 63, 90.5, 150 C, 158 S, 155 R, 155 S; 2/247, 251, 265, 279

[56] References Cited

U.S. PATENT DOCUMENTS

| | | | |
|---|---|---|---|
| 1,183,392 | 5/1916 | Meek | 24/13 |
| 1,310,282 | 7/1919 | Clark | 2/251 |
| 1,869,261 | 7/1932 | Jennings | 2/247 X |
| 2,609,979 | 9/1952 | Spann | 224/911 X |
| 3,184,759 | 5/1965 | Masters | 2/279 |
| 3,357,063 | 12/1967 | Eiben | 24/155 X |
| 3,923,214 | 12/1975 | Kippen | 224/911 |

*Primary Examiner*—Robert J. Spar
*Assistant Examiner*—Jerold M. Forsberg
*Attorney, Agent, or Firm*—Jones, Thomas & Askew

[57] ABSTRACT

A concealment holster which fits an article such as a firearm to be carried in complete concealment. The holster is provided by an elongated pouch having a rounded bottom and an open top, so as to contain a handgun in butt-inverted position. The pouch is detachably connected to the shirttail of a wearer so that the pouch and its contents are hidden behind and/or beneath the wearer's trousers waistband.

5 Claims, 5 Drawing Figures

CONCEALMENT HOLSTER

DESCRIPTION

Background

This invention relates in general to a device for carrying an article in concealment on the body of a person, and in particular to a holster for carrying a weapon in complete concealment.

There are many circumstances where it is desirable or necessary for a person to carry an article in complete concealment on his or her person. Articles such as passports, money, jewelry, or other valuables may be carried in concealment by a person, because concealed items are more likely to be untouched if a conventional carrier such as a purse or wallet is stolen. Handguns are often carried in concealment by law enforcement officers and others who are authorized or licensed to do so, and it is often desirable to carrying "concealed" weapons in complete concealment on the wearer's body. The concept of complete concealment, in the context of concealed weapons, means that the weapon will not be visible to a casual observer even when the wearer removes a coat or other outer garment.

Holsters for carrying handguns or other articles in partial or complete concealment are not new, and several types of concealment holsters are known. These conventional concealment holsters are typically less than satisfactory for many applications. The conventional shoulder holster, for example, is immediately visible whenever the wearer's coat or jacket is removed or even unbuttoned. Moreover, the entire weight of the shoulder holster and the gun it contains is transferred to one shoulder of the wearer, and that weight and its unbalance with respect to body symmetry can become uncomfortable.

Other types of concealment holsters are attached to the wearer's belt by various techniques, and fit either within the belt or immediately outside the belt for concealment by the wearer's coat. Handguns carried in hip-mounted holsters of the prior art are typically visible whenever the wearer's coat is removed, thus destroying the "concealment" value for undercover work or informal dress occasions.

Other types of holsters are known which offer relatively complete concealment of a handgun. For example, the ankle holster is attached to the ankle of a wearer by a band which encircles the ankle, so that the holster and contents are covered by a pants leg. Ankle holsters are known to be exceedingly uncomfortable for many persons, however, and a handgun carried in an ankle holster is obviously not within easy reach in many situations.

Other types of holsters offering full concealment are strapped directly to the wearer's body, such as behind a shirt or within a brassiere. While handguns or other articles so carried may be fully concealed, the article is typically accessible only by partially unfastening a shirt, a relatively slow and awkward procedure which is not favored by most persons carrying concealed handguns.

BRIEF SUMMARY OF INVENTION

The present invention overcomes many of the problems associated with the prior art by providing a concealment holster which is attachable to an article of clothing such as a shirttail, and which is designed to fit behind the waistband of the wearer's trousers so that the holster is carried in complete concealment, yet lies readily at hand for drawing or holstering an article such as a handgun. Stated somewhat more particularly, the concealment holster of the present invention forms an elongated pouch which supports a handgun in an inverted butt-up position, with the gun barrel being substantially horizontal in a preferred mode of use. The concealment holster may be made from a single piece of material, and is designed for use by either a right-handed or left-handed shooter. Stated even more particularly, the concealment holster of the present invention is intended to be removably secured to the shirttail of a wearer, with the free end of the shirttail folded about the bottom of the holster to form a flap which positions the holster at a desired location such as behind the trousers waistband of the wearer. The weight of the holster and handgun are thus transferred to the shirt and distributed more uniformly over the shoulders of the wearer.

Accordingly, it is an object of the present invention to provide an improved concealment device for carrying an article in complete concealment on a person.

It is another object of the present invention to provide an improved concealment holster for a handgun.

It is still another object of the present invention to provide a concealment holster which carries a handgun or other article in complete concealment on the person of a wearer.

It is a further object of the present invention to provide a concealment holster which is relatively comfortable to wear.

The nature of the present invention as well as other objects and advantages thereof will become apparent from the following discussion of disclosed preferred embodiments of the invention.

DETAILED DESCRIPTION OF DISCLOSED EMBODIMENTS

Figures 1, 2, 3:
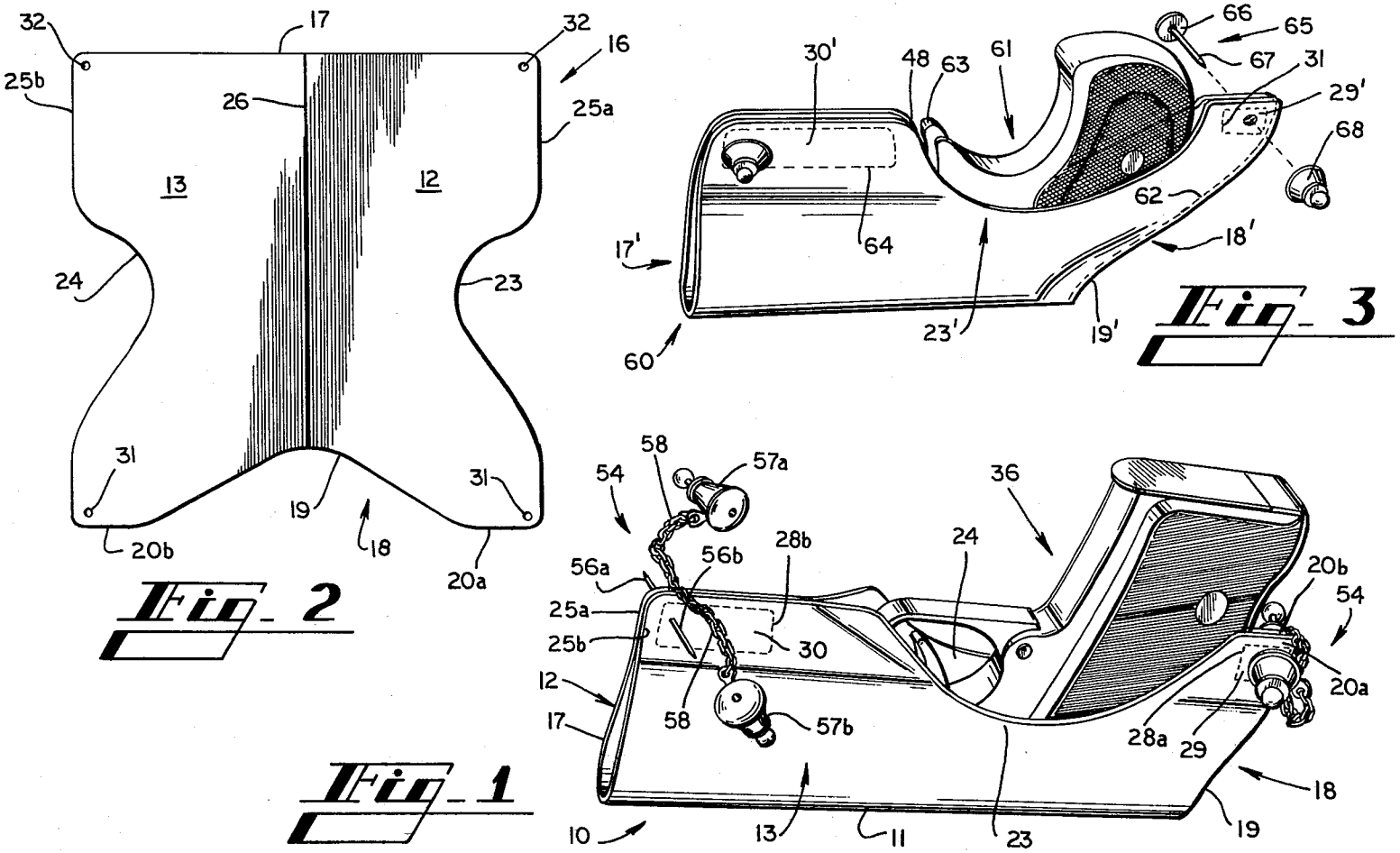
FIG. 1 is a pictorial view of a concealment holster according to a first disclosed embodiment of the present invention.
FIG. 2 is a plan view showing a unitary piece of material from which the holster of FIG. 1 is made.
FIG. 3 is a pictorial view showing another embodiment of the present invention.

Turning first to FIG. 1, there is shown generally at 10 a holster in the form of a generally elongated pouch having a bottom 11 and a pair of sides 12 and 13. The side 12 will be here identified as the "inside" and the side 13 as the "outside", although the two sides are preferably identical and the designations merely denote the sides respectively facing toward and away from the wearer's body.

The holster 10 is preferably formed from a single piece 16 of suitable material, such as leather or the like, which may be cut from a flat sheet of material. One such flat piece 16 is shown in FIG. 2, and has a generally rectangular outline with cut-away portions as explained below. The piece has a straight front end 17, and a second or back end 18 having a central portion 19 which is cut inwardly somewhat from the outermost extent defined by the two tabs 20*a* and 20*b* at the outermost extent of the back end. Each of the sides 12 and 13 has a cutout region extending inwardly from the outermost extent of the piece 16, and respectively designated 23 and 24. Each of the side cutout regions 23 and 24 is located between the tabs 25*a*, 25*b* located at the extremities of the front end 17, and the corresponding tabs 20*a* and 20*b* at the back end 18 of the piece 16.

The flat piece 16 is preferably of leather or a comparable material which is relatively flexible, and the flat piece either can be individually cut from a sheet of stock material or can be stamped from the material with a suitable tool such as a cutting die or the like. Once the piece 16 is obtained, the piece is folded along the imaginary fold line 26 (FIG. 2) to assume the elongated pouch configuration shown in FIG. 1. It will be seen from FIG. 1 that the piece of material 16 is folded so that the tabs 20*a* and 20*b* at the back end 18 are mutually aligned, as are the tabs 25*a* and 25*b* at the front end 17 of the piece. Each pair of aligned tabs is now permanently connected together by any suitable technique, such as by stitching or the like. Referring to FIG. 1, the two sets of aligned tabs are stitched together by stitching 28*a* which forms an enclosed area 29, at the rear tabs 20*a* and 20*b*, and by stitching 28*b* which forms the enclosed area 30 at the front tabs 25*a* and 25*b*. Each of these stitched enclosed areas 29 and 30 is penetrated by an opening 31 and 32, respectively, which may simply be punched through the opposed and interconnected thicknesses of the material 16; these openings are illustratively shown in the piece of material 16 in FIG. 2. The openings 31 and 32 receive the coact with the connective devices which secure the holster 10 to an article of apparel worn by the user, as described below.

It is seen from FIG. 1 that the holster 10 has a bottom 11 having a generally curved interior surface which conforms in shape to the upper surface of the barrel or action slide of a handgun for which the particular holster is designed. Moreover, the front end 17 of the holster remains open below the stitched-together tabs 25*a* and 25*b* so as to accommodate the forward or muzzle end of the handgun barrel, and the back end 18 of the holster similarly remains open to accommodate the back end of the gun. While it may not be necessary or desirable in every case to have both ends of the holster 10 remain open, the open ends allow the entire interior length of the holster adjacent its bottom 11 to remain expanded for accommodating the bulk of a handgun, including an exposed hammer (if present) and/or the thickness of the slide of an autopistol.

The holster 10 is provided with a pair of double-ended tacks 54 for securing the holster to the shirttail or other apparel of the wearer. Each double-ended tack 54 is permanently attached at an end of the holster 10, between the interconnected pairs of tabs 25*a*, 25*b* and 20*a*, 20*b*. Each of the double-ended tacks 54 includes a head (hidden from view in FIG. 1) and a pair of coaxially aligned shanks 56*a* and 56*b* extending upwardly from each side of the head. At the time the holster 10 is assembled, a tack 54 is inserted between each pair of opposed tabs, with the head of the tack sandwiched between the tabs and shanks 56*a* and 56*b* extending through each of the openings 31 or 32 formed in the tabs. The two pairs of tabs are then stitched or otherwise secured together as previously described, so that a double-end tack 54 is permanently secured to the top of the holster 10 at both the front and back ends thereof.

A pair of fasteners such as clutchbacks 57*a* and 57*b* are connected to each of the tacks 54 by a suitable means such as short lengths of flexible chain 58 or the like. The double-ended tacks 54 and associated clutchbacks 57 thus remain permanently attached to the holster 53 and cannot become lost or misplaced when the clutchbacks are disconnected from the tacks.

FIG. 3 shows a concealment holster 60 according to another embodiment of the present invention. The holster 60 is designed to accommodate a relatively small handgun such as the derringer 61, and differs from the holster 10 primarily in the back end 18' and the enclosed area 30' at the front end 17' of the holster. The back end 18' has a cutout portion 19' which is more pronounced than the corresponding portion of the holster 10, and the entire back end 18' is closed by stitching 62 or the like. The enclosed area 30' defined by stitching 64 extends rearwardly to a point just short of the forward edge 48 of the cutout region 23'. Proper longitudinal positioning of the relatively slender derringer 61 within the holster 60 is thus provided by the forward edge 48, which contacts the unguarded trigger 63 of the derringer, and by the closed back end 18' of the holster.

The holster 60 is shown with a single-end securing tack 65 at each end for securing the holster to the shirttail or other apparel of the wearer, rather than the double-ended tacks 54 employed with the holster 10 described above. Each tack 65 has a head 66 and shank 67 which extends outwardly from the head to pass through the opening 31 or 32 formed in the tabs of the holster; a clutchback 68 removably attaches to the free end of the shank.

Although the single-end securing tack 65 is shown and described in the context of the holster embodiment 60, it should be understood that either the single-end securing tack or the previously-described double-end securing tack may be used with various embodiments of holsters according to the present invention. The use of single-end securing tacks with a holster 10 is described below.

Figure 5:
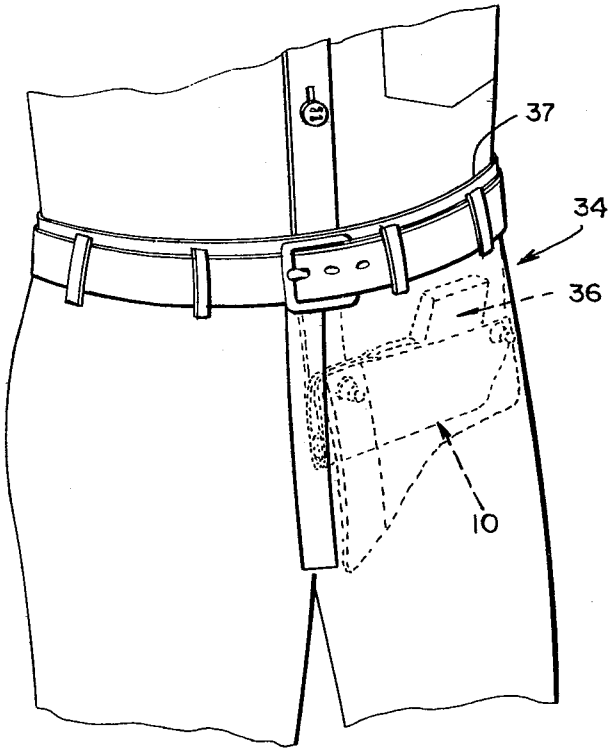
FIG. 5 is a partial pictorial view showing, in phantom lines, the attached holster of FIG. 4 worn in concealment within the trousers of a wearer.
Figure 4:
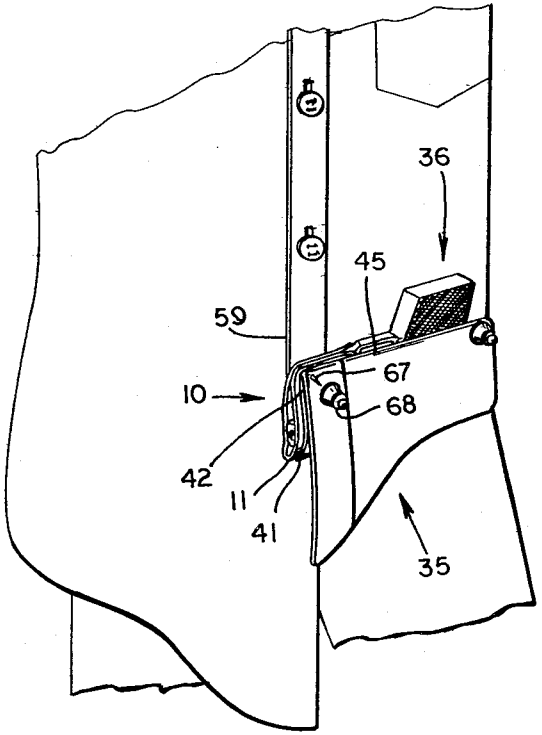
FIG. 4 is a partial pictorial view showing a modified version of the holster shown in FIG. 1, attached to the shirttail of a wearer.

Turning next to FIGS. 4 and 5, the holster 10 is shown in a typical attachment to the shirttail 35 of a wearer. The holster 10 is initially positioned on the shirttail at a location that will allow the holster and the handgun 36 therein to be carried comfortably and completely concealed within the waistband or top portion 37 of the wearer's trousers 35. One of two single-end tacks 65 is inserted through the shirt from the back or body-contacting side thereof, so that the shank of each tack extends through the shirt and through the openings 31, 32 formed in the interconnected tabs at both ends of the holster 10. The shirttail is now folded upwardly as shown at 41 around the bottom 11 of the holster and continues upwardly along the outside of the holster, as shown at 42. The shirttail 35 is now looped or folded back downwardly adjacent the top of the holster, as shown at 45, so that the remainder of the shirttail extends downwardly along the outside of the holster. The shank 67 of each tack 65, extending through the outside of the holster, is next pushed through both layers of the shirttail 35 below the top fold 45. A securing device such as the clutchback 68 is next attached to the open end of the shank 67 of each tack 65, thus completing the attachment of the holster to the shirttail. The shirttail with holster 10 attached is now tucked within the wearer's trousers, placing the holster and the handgun 36 therein completely in concealment behind and/or below the trousers waistband 37 as seen in phantom in FIG. 5.

It will be understood that the bottom fold 41 of the shirttail lies along the bottom 11 of the holster, so that the weight of the holster and handgun contained therein is transferred to the shirt. The weight of holster and gun is thus transferred through the shirt to the shoulders of the wearer and is spread relatively evenly on the shoulders, in contrast to the conventional shoulder holster having a shoulder strap which fits over the wearer's shirt and applies its weight along a relatively concentrated area beneath that strap. Furthermore, the natural inward pressure of the trousers 34 against the holster 10 may partially support the holster and reduce the additional amount of weight carried by the upper body of the wearer.

FIGS. 1 and 5 show that the handgun 36 is carried in concealment within the holster 10 in butt-up substantially inverted configuration. The location of the holster behind or below the waistband 37 can be adjusted to suit the comfort of the particular wearer, although the holster position just behind beltline or waistband best allows access to the handgun. The cutout regions 23 and 24 along the sides 12 and 13 of the holster allow the butt and part of the trigger guard to remain exposed, to facilitate holstering and unholstering the gun. The dimensions of a holster according to the present invention and intended for a particular type of gun are thus determined to some extent by the shape and size of that gun. The depth and front-back location of the cutout regions 23 and 24 is determined by the shape of the trigger and trigger guard, including trigger spacing from the top of the barrel (which rests on the curved bottom 11). The angle at which the cut-out portion 19 at the back end 18 of the holster is raked forwardly, as viewed in FIGS. 1 and 3, is determined by the back configuration of the gun, and as described above with respect to FIG. 3 the back end 18' may be entirely closed with stitching so as to help contain the relatively small gun.

The relative width of the cylinder in a revolver, or the width of the action slide in an autopistol, typically locates the gun within the holster without need for additional stitching as shown at 64 in FIG. 3.

A holster having a double-ended tack 54 is attached to a shirttail by first positioning the holster relative to the shirttail as described above. When the proper elevation of the holster is determined, the inwardly-facing shank **56*a* of the tack at the front end of the holster is pushed through the shirt, and the clutchback 57*a* is secured to the inwardly-facing shank by looping the length of chain 58 around the vertical edge 59 (FIG. 4) of the shirt opening. The shirttail is next folded upwardly around the outside of the holster and folded as at 45 to extend back down along the outside of the holster, as described above, after which the outwardly-facing shank 56*b* at the front end of the holster is pushed through the two folded shirttail layers and secured by the clutchback 57*b*. The outwardly-facing shank 56*b* of the tack at the back end 18 of the holster 10 is similarly connected to the folded-over shirttail. The inwardly-facing shank 56*a* at the back end of the holster may simply be covered by the associated clutchback 57*a* to prevent the pointed shank from stabbing the wearer, inasmuch as the holster 10 is adequately supported against falling forward by the combined effect of the surrounding trousers and the secured double-ended tack at the front end 17 of the holster. If desired, however, the inwardly-facing tack at the back end of the holster 53 can be secured through the shirt by pinching a fold of shirt material adjacent that shank and then inserting the shank through both pinched layers, leaving the free end of the shank 56*a* accessible behind the pinched layers to receive the connected clutchback 57*a***.

The foregoing technique of pinching a fold in the shirt to provide access for attaching the clutchback to the inwardly-facing shank of the double-ended tack 54 can also be used when attaching the present holster to a shirt such as a pullover or the like, which has a solid front lacking an edge around which the interconnecting chain 58 of the clutchback can extend. Alternatively, a concealment holster with single-end tacks 65 can be used when a solid-front shirt is worn.

It should be understood that the foregoing relates only to preferred embodiments of the present invention, and that numerous changes and modifications may be made therein without departing from the spirit and scope of the invention as defined in the following claims.

I claim:

1. A concealment holster for a firearm, comprising:

a unitary member forming and defining a pouch for receiving and retaining a handgun in an inverted butt-up position;

said unitary member having an elongated substantially flat bottom portion with a generally curved interior surface configured to accommodate and support the barrel of the handgun disposed in the inverted position within said pouch, and further having a pair of side portions each extending away from said bottom portion to terminate at an outer edge in spaced apart relation to said bottom portion so as to provide external support for the handgun, at least one end of said pouch being open to accommodate a longitudinal extremity of the handgun;

each said side portion having a tab portion at either end of said outer edge, with the tab portions at corresponding ends of each side portion being in mutually confronting relation;

the exterior of said unitary member along said elongated bottom portion forming a curved surface about which the shirttail of the wearer is folded to locate the holster in concealment within the trousers of the wearer;

means securing together said confronting tab portions at each end of said outer edge so as to maintain said outer edges between said secured tab portions open to permit holstering and unholstering the handgun from the pouch, so that the butt of the holstered handgun extends upwardly through the opening between the secured tab portions;

means for detachably connecting said pouch to said shirttail of a wearer with the shirttail folded around the curved exterior bottom surface of the pouch to support the weight of the pouch and a handgun holstered in the pouch in said inverted position, and with said shirttail folded upwardly along a side portion of the pouch for engagement by said connecting means, so that the holster and handgun are concealed from view within trousers of the wearer; and said connecting means comprising pin means extending through one of said tab portions to engage the upwardly folded shirttail along one side of the pouch, and to engage the shirt along the opposite side of the pouch, so as to maintain the pouch attached to the shirt.

2. A holster as in claim 1, wherein:

at least one of said side portions has a cutout region located between the tab portions for that side portion, and extending inwardly partially toward said bottom portion, said cutout region at least partially exposing the butt of the handgun and thereby facilitating holstering and unholstering the handgun.

3. A holster as in claim 1, wherein said pin means comprises:

first pin means extending through said side portions adjacent said confronting tab portions at one end of said outer edge, and also extending through the shirttail;

second pin means extending through the side portions adjacent said confronting tab portions at the other end of the outer edge, and also extending through the shirttail; and securement means selectably engageable with said pin means to retain the shirttail thereon, so that the pouch is connected in predetermined location on the shirttail, and the weight of the holster and its contents are transferred through the shirt to the shoulders of the wearer.

4. A holster as in claim 1, wherein said pin means comprises:

a pin assembly secured to said pouch at each said end of said side portion, and located adjacent said confronting tab portions of said side portions at each of the ends;

each said pin assembly comprising a pair of pins protruding in opposite directions through said side portions, so that one pin of each pair extends rearwardly from the side portion adjacent the wearer's body to penetrate the shirtail, and the other pin of each pair extends forwardly from the other side portion to penetrate the shirtail folded beneath said bottom portion of said unitary member and upwardly along the othe side portion; and securement means selectably operative to retain the shirttail on said pins.

5. A holster as in claim 4, wherein:

said securement means comprises means removably attachable on each of said pins to retain the shirttail thereon; and means connecting said removably attachable means to said holster to prevent said attachable means from becoming separated from said holster when removed from said pin.

* * * * *